United States Patent [19]

Kamio et al.

[11] Patent Number: 4,570,453

[45] Date of Patent: Feb. 18, 1986

[54] APPARATUS FOR CONTINUOUSLY COOLING HEATED METAL PLATE

[75] Inventors: Hiroshi Kamio, Tokyo; Yasushi Ueno, Yokohama; Takao Noguchi, Tokyo; Kazuo Kunioka; Shuzo Fukuda, both of Yokohama, all of Japan

[73] Assignee: Nippon Kokan Kabushiki Kaisha, Tokyo, Japan

[21] Appl. No.: 648,878

[22] Filed: Sep. 10, 1984

[30] Foreign Application Priority Data

Sep. 27, 1983 [JP] Japan ..... 58-177097

[51] Int. Cl.[4] ..... F25D 17/02

[52] U.S. Cl. ..... 62/375; 72/201; 148/143; 148/153

[58] Field of Search ..... 72/201; 148/143, 153; 62/63, 64, 374, 375

[56] References Cited

U.S. PATENT DOCUMENTS 3,659,428 5/1972 Kunioka et al. ..... 62/64
4,439,990 4/1984 Leloux ..... 62/375
4,497,180 2/1985 Graham ..... 62/374

FOREIGN PATENT DOCUMENTS 55-156612 12/1980 Japan .

*Primary Examiner*—Ronald C. Capossela
*Attorney, Agent, or Firm*—Frishauf, Holtz, Goodman & Woodward

[57] ABSTRACT

An apparatus for continuously cooling a heated metal plate lying horizontally, which comprises: an upper cooling water ejecting means, arranged above the metal plate in parallel to the width direction thereof, for ejecting cooling water onto the upper surface of the metal plate; a water tank, arranged below the metal plate, for receiving cooling water; and a lower cooling water ejecting means having a lower cooling water ejecting bore, arranged in the water tank in parallel to the width direction of the metal plate. The lower cooling water ejecting means ejects, in the form of a jet stream, cooling water from the lower cooling water ejecting bore together with cooling water received in the water tank, onto the lower surface of the metal plate. The above-mentioned jet stream is surrounded by a jet stream guide duct arranged between the lower cooling water ejecting means and the lower surface of the metal plate.

10 Claims, 18 Drawing Figures

APPARATUS FOR CONTINUOUSLY COOLING HEATED METAL PLATE

REFERENCE TO PATENTS, APPLICATIONS AND PUBLICATIONS PERTINENT TO THE INVENTION

Japanese Patent Provisional Publication No. 55-156,612 dated Dec. 5, 1980, the contents of which will be discussed under the heading of the "BACKGROUND OF THE INVENTION".

FIELD OF THE INVENTION

The present invention relates to an apparatus for cooling a heated metal plate such as a heated steel plate or other metal plate immediately after hot rolling, which allows continuous and uniform cooling without causing strain and so as to obtain desired properties.

BACKGROUND OF THE INVENTION

For the purpose of improving strength and toughness of a hot-rolled steel plate or other heated metal plate, it is the conventional practice to eject cooling water onto the upper and lower surfaces of the heated metal plate horizontally moving in the longitudinal direction thereof to cool the metal plate to a prescribed temperature.

The conventional apparatus for cooling a heated metal plate to a prescribed temperature comprises upper cooling water ejecting nozzles for ejecting cooling water substantially vertically onto the upper surface of the metal plate, an upper nozzle header for supplying cooling water to the upper cooling water ejecting nozzles, lower cooling water ejecting nozzles for ejecting cooling water onto the lower surface of the metal plate, and a lower nozzle header for supplying cooling water to the lower cooling water ejecting nozzles.

As shown in FIG. 1, the plurality of upper cooling water ejecting nozzles 2 are arranged spaced apart from each other at prescribed intervals, above the heated metal plate (not shown) in the width direction of the heated metal plate, and eject cooling water supplied from the upper nozzle header 1 substantially vertically in the form of a lamination onto the upper surface of the metal plate.

The plurality of lower cooling water ejecting nozzles (not shown) are arranged spaced apart from each other at prescribed intervals below the heated metal plate in the width direction thereof, and eject cooling water supplied from the lower nozzle header (not shown) substantially vertically in the form of a mist onto the lower surface of the metal plate.

In the above-mentioned apparatus for cooling the heated metal plate, it is very important, with a view to reducing strain and other inconveniences produced in the metal plate, that the upper cooling water ejecting nozzles 2 and the lower cooling water ejecting nozzles have substantially the same cooling abilities.

For this purpose, it was the usual practice, in the above-mentioned apparatus for cooling the heated metal plate, to increase the flow rate of cooling water supplied from the lower nozzle header to the lower cooling water ejecting nozzles to from 2.0 to 2.5 times greater than the flow rate of cooling water supplied from the upper nozzle header 1 to the upper cooling water ejecting nozzles 2.

The reason is as follows. Cooling water after ejection from the lower cooling water ejecting nozzles onto the lower surface of the heated metal plate leaves immediately the lower surface and drops down, whereas cooling water after ejection from the upper cooling water ejecting nozzles onto the upper surface of the metal plate stays for a while on the upper surface, and consequently brings about a secondary cooling effect. Therefore, if cooling water ejected onto the upper surface of the heated metal plate has the same flow rate as that of cooling water ejected onto the lower surface thereof, the upper surface would be more easily cooled than the lower surface.

However, ejecting cooling water in a large quantity onto the lower surface of the metal plate as mentioned above is not desirable from the point of view of resource saving.

A cooling apparatus solving the above-mentioned problem is disclosed in Japanese Patent Provisional Publication No. 55-156,612 (hereinafter referred to as the "prior art"). The principle of the apparatus for cooling a heated metal plate of the prior art is described below with reference to FIG. 2.

As shown in FIG. 2, a heated metal plate 3 is laid horizontally. A water tank 4 comprising a bottom wall 4*a* and side walls 4*b*, for receiving cooling water, is arranged below the heated metal plate 3. The water tank 4 has a size sufficient to collect the total amount of a jet stream described later. The bottom wall 4*a* of the water tank 4 is provided with a plurality of lower cooling water ejecting nozzles 5 substantially vertically arranged spaced apart from each other at prescribed intervals in the width direction of the heated metal plate 3. The uppermost end of each lower cooling water ejecting nozzle 5 is located under the surface of cooling water received in the water tank 4. A lower nozzle header 6 for supplying cooling water to the lower cooling water ejecting nozzles 5 is connected to these nozzles 5. A plurality of upper cooling water ejecting nozzles (not shown) similar to those shown in FIG. 1 are arranged above the heated metal plate 3 spaced apart from each other at prescribed intervals in the width direction of the heated metal plate 3 and eject cooling water substantially vertically onto the upper surface of the heated metal plate 3.

In the above-mentioned apparatus for cooling a heated metal plate of the prior art, when cooling water is supplied from the lower nozzle header 6 to the lower cooling water ejecting nozzles 5 in the state of the water tank 4 filled with cooling water, both cooling water from the lower cooling water ejecting nozzles 5 and cooling water received in the water tank 4 are ejected in the form of a jet stream 7 substantially vertically onto the lower surface of the heated metal plate 3, and thus the heated metal plate 3 is cooled to a prescribed temperature. The jet stream 7 after ejection onto the lower surface of the heated metal plate 3 is totally collected in the water tank 4. Cooling water in an amount substantially equal to that of cooling water supplied from the lower nozzle header 6 to the lower cooling water ejecting nozzles 5 overflows from the water tank 4.

According to the above-mentioned cooling apparatus of the prior art, it is possible to cool the lower surface of the heated metal plate by cooling water at a flow rate several times as large as that of cooling water from the lower cooling water ejecting nozzles 5, thus remarkably improving the cooling ability of the cooling apparatus. In addition, since the jet stream 7 after ejection onto the lower surface of the heated metal plate 3 is totally collected into the water tank 4, only the amount of cooling water supplied from the nozzle header 6 to the lower cooling water ejecting nozzles 5 is consumed as the overflow from the water tank 4. Consumption of cooling water is thus largely reduced.

The prior art described above has however the following problems:

When the position of the uppermost end of the lower cooling water ejecting nozzle 5 and the flow rate of cooling water supplied to the nozzle 5 are kept constant, the flow rate of the jet stream 7 varies in response to the variation of the surface level of cooling water received in the water tank 4. More specifically, if the distance between the lower surface of the heated metal plate 3 and the surface level of cooling water in the water tank 4 is kept constant, the ability to cool the heated metal plate 3 depends upon the flow rate of the jet streams 7. It is therefore necessary to keep always constant the surface level of cooling water in the water tank 4 in order to uniformly cool the heated metal plate 3. However, dropping of the jet stream 7 after ejection onto the lower surface of the heated metal plate 3 into the water tank 4 causes considerable up and down wavy movements of the surface of cooling water in the water tank 4, and the uppermost end of the lower cooling water ejecting nozzle 5 may sometimes be even exposed above the water surface. Furthermore, when the jet stream 7 falls into the water tank 4 as mentioned above, innumerable bubbles are produced on the surface of cooling water in the water tank 4, and these bubbles are entangled into the jet stream 7, thus deteriorating the cooling ability. Thus, according to the prior art, the heated metal plate cannot be uniformly and efficiently cooled.

Another method has recently been developed which comprises subjecting a heated steel plate immediately after hot rolling to an online controlled cooling to minimize alloy elements, and thus manufacturing a high-strength steel plate excellent in toughness. In this method, it is necessary to control the cooling rate of the heated steel plate in response to the thickness and other particulars of the plate in order to manufacture a steel plate with a desired quality, and a wider range of control of the cooling rate permits manufacture of more kinds of steel plate. However, if the flow rate of cooling water from the lower cooling water ejecting nozzles 5 is reduced to decrease the cooling rate, the jet stream 7 may not reach the lower surface of the headed steel plate, and if the flow rate of cooling water from the lower cooling water ejecting nozzles 5 is increased to increase the cooling rate, on the contrary, the jet stream 7, reaching the lower surface of the heated steel plate, is ejected in a state close to mist onto the surface of the heated steel plate, and the cooling rate cannot be increased. Thus, according to the cooling apparatus of the prior art, the cooling rate of the heated metal plate cannot be controlled over a wide range.

Under such circumstances, there is a demand for the development of an apparatus which permits, when cooling a heated metal plate horizontally lying above a water tank to a prescribed temperature by means of a jet stream produced by cooling water from lower cooling water ejecting nozzles arranged in the water tank and cooling water received in the water tank, uniform and efficient cooling of the heated metal plate and also control of the cooling rate over a wide range. However, such an apparatus is not as yet proposed.

SUMMARY OF THE INVENTION

An object of the present invention is therefore to provide an apparatus which permits, when cooling a heated metal plate horizontally lying above a water tank to a prescribed temperature by means of a jet stream produced by cooling water from lower cooling water ejecting nozzles arranged in the water tank and cooling water received in the water tank, uniform and efficient cooling of the heated metal plate.

Another object of the present invention is to provide an apparatus which permits, when cooling a heated metal plate horizontally lying above a water tank to a prescribed temperature by means of a jet stream produced by cooling water from lower cooling water ejecting nozzles arranged in the water tank and cooling water received in the water tank, control of the cooling rate over a wide range.

In accordance with one of the features of the present invention, there is provided an apparatus for continuously cooling a heated metal plate lying horizontally, which comprises:

an upper cooling water ejecting means, arranged above said metal plate along at least one straight line parallel to the width direction of said metal plate, for substantially vertically ejecting cooling water onto the upper surface of said metal plate; an upper nozzle header for supplying cooling water to said upper cooling water ejecting means; at least one water tank, arranged below said metal plate, for receiving cooling water; a lower cooling water ejecting means having a lower cooling water ejecting bore, arranged in said water tank along at least one straight line parallel to the width direction of said metal plate, said lower cooling water ejecting bore being located under the surface of cooling water received in said water tank, said lower cooling water ejecting means ejecting, in the form of a jet stream, cooling water from said lower cooling water ejecting bore together with cooling water received in said water tank, substantially vertically onto the lower surface of said metal plate, said jet stream after ejection onto the lower surface of said metal plate being totally collected into said water tank; and a lower nozzle header for supplying cooling water to said lower cooling water ejecting means;

characterized by:

a jet stream guide duct arranged substantially vertically between said lower cooling water ejecting means and the lower surface of said metal plate so as to surround said jet stream, the lower portion of said jet stream guide duct being immersed into cooling water received in said water tank, the lowermost end of said jet stream guide duct being close to said lower cooling water ejecting bore of said lower cooling water ejecting means, and the uppermost end of said jet stream guide duct being spaced apart from the lower surface of said metal plate.

DETAILED DESCRIPTION OF PREFERRED EMBODIMENTS

From the above-mentioned point of view, extensive studies were carried out to develop an apparatus which permits, when cooling a heated metal plate lying horizontally above a water tank to a prescribed temperature by means of a jet stream produced by cooling water from lower cooling water ejecting nozzles arranged in the water tank and cooling water received in the water tank, uniform and efficient cooling of the metal plate and also control of the cooling rate over a wide range. As a result, the following finding was obtained. The flow rate of the jet stream depends upon the flow rate of cooling water from the water tank, which is to be entangled or mixed into cooling water from the lower cooling water ejecting nozzle, and the flow rate of the above-mentioned cooling water to be entangled depends upon the distance between the surface of cooling water in the water tank and the uppermost end of the lower cooling water ejecting nozzle. It is therefore possible to constantly keep the flow rate of the jet stream at a prescribed value even when the distance between the surface of cooling water in the water tank and the uppermost end of the lower cooling water ejecting nozzle varies, by arranging substantially vertically a jet stream guide duct between the lower cooling water ejecting nozzle and the lower surface of the heated metal plate so as to surround the jet stream, and ejecting the jet stream through the jet stream guide duct.

The present invention was made on the basis of the above-mentioned finding. Now, the apparatus for continuously cooling a heated metal plate of the present invention is described below with reference to the drawings.

Figure 1:
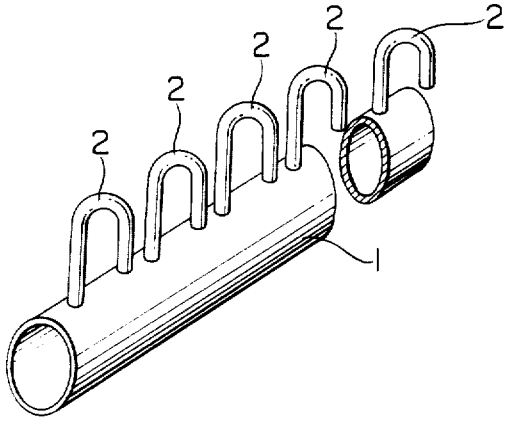
FIG. 1 is a partially omitted perspective view illustrating conventional upper cooling water ejecting nozzles fitted to an upper nozzle header.
Figure 2:
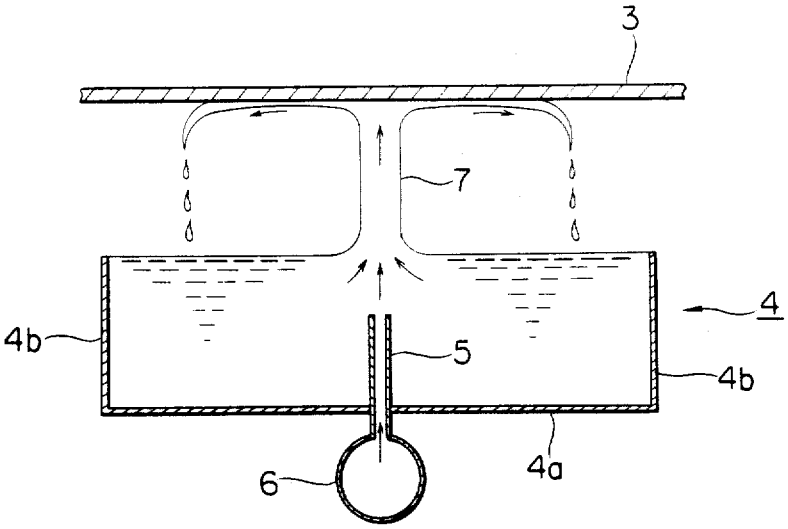
FIG. 2 is a cross-sectional view illustrating the principle of the cooling apparatus of the prior art.
Figure 3:
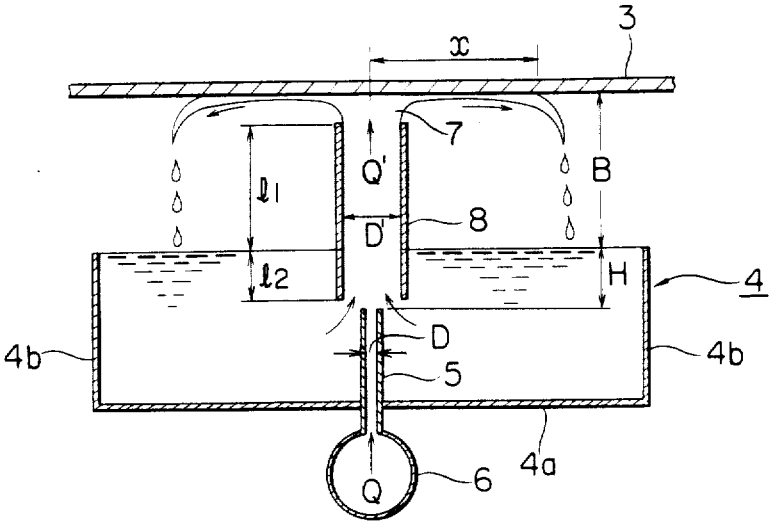
FIG. 3 is a cross-sectional view illustrating the principle of the cooling apparatus of the present invention.
Figure 4:
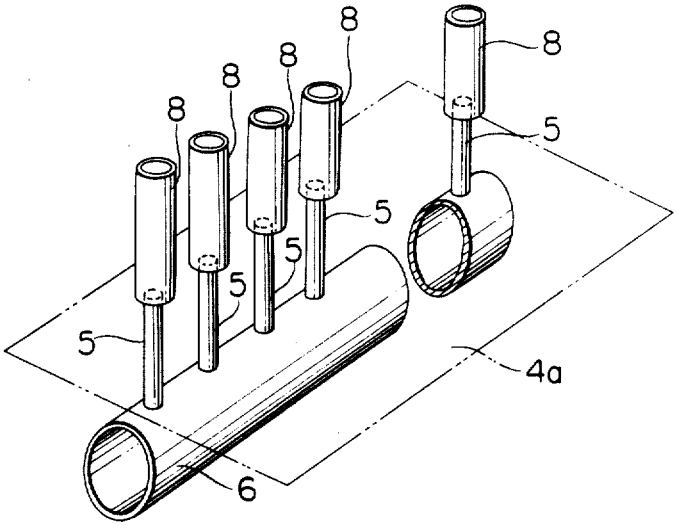
FIG. 4 is a partially omitted perspective view illustrating an embodiment of the combination of a lower cooling water ejecting nozzle fitted to a lower nozzle header and a jet stream guide duct in the cooling apparatus of the present invention.

FIG. 3 is a cross-sectional view illustrating the principle of the apparatus for cooling a heated metal plate of the present invention. As shown in FIG. 3, a heated metal plate 3 is laid horizontally. A water tank 4 comprising a bottom wall 4*a* and side walls 4*b*, for receiving cooling water, is arranged below the heated metal plate 3. The water tank 4 has a size sufficient to collect the total amount of a jet stream described later after ejection onto the lower surface of the heated metal plate 3. As shown in FIG. 4, a plurality of lower cooling water ejecting nozzles 5 are substantially vertically arranged spaced apart from each other at prescribed intervals in the bottom wall 4*a* of the water tank 4 along at least one straight line parallel to the width direction of the heated metal plate 3. The uppermost end of each lower cooling water ejecting nozzle 5 is located under the surface of cooling water received in the water tank 4. Each lower cooling water ejecting nozzle 5 ejects cooling water supplied from a lower nozzle header 6 to the nozzle 5 together with cooling water received in the water tank 4 in the form of a jet stream 7 substantially vertically onto the lower surface of the heated metal plate 3. Between each of the plurality of lower cooling water ejecting nozzles 5 and the lower surface of the heated metal plate 3, a jet stream guide duct 8 is substantially vertically arranged so as to surround the jet stream 7. The cross-sectional area of the jet stream guide duct 8 is larger than that of the lower cooling water ejecting nozzle 5. The lower portion of the jet stream guide duct 8 is immersed into cooling water received in the water tank 4, and the lowermost end of the jet stream guide duct 8 is close to the uppermost end of the lower cooling water ejecting nozzle 5, and the uppermost end of the jet stream guide duct 8 is spaced apart from the lower surface of the heated metal plate 3. The lower nozzle header 6 for supplying cooling water to the lower cooling water ejecting nozzles is connected to these nozzles 5. Above the heated metal plate 3, a plurality of upper cooling water ejecting nozzles (not shown) similar to those as shown in FIG. 1 are arranged spaced apart from each other at prescribed intervals along at least one straight line parallel to the width direction of the heated metal plate 3, and eject cooling water substantially vertically onto the upper surface of the metal plate 3.

In the above-mentioned apparatus for cooling a heated metal plate of the present invention, when cooling water is supplied from the lower nozzle header 6 to the lower cooling water ejecting nozzles 5 in the state of the water tank 4 filled with cooling water, cooling water from each of the lower cooling water ejecting nozzles 5 and cooling water received in the water tank 4 are ejected in the form of a jet stream 7 through the jet stream guide duct 8 substantially vertically onto the lower surface of the heated metal plate 3. At the same time, cooling water supplied from the upper nozzle header 1 shown in FIG. 1 to the plurality of upper cooling water ejecting nozzles 2 shown also in FIG. 1 is ejected substantially vertically onto the upper surface of the heated metal plate 3. Thus, the heated metal plate 3 is uniformly cooled to a prescribed temperature. The total amount of the jet stream 7 after ejection onto the lower surface of the heated metal plate 3 is collected into the water tank 4. Cooling water in an amount substantially equal to that of the cooling water supplied from the lower nozzle header 6 to the lower cooling water ejecting nozzles 5 overflows from the water tank 4.

Figure 5:
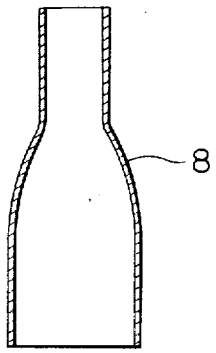
FIG. 5 is a longitudinal sectional view illustrating an embodiment of a jet stream guide duct in the cooling apparatus of the present invention.

The above-mentioned jet stream guide duct 8 may be one having a cross-sectional area uniform in the axial direction as mentioned above, or may also be one in which the upper cross-sectional area is smaller than the lower cross-sectional area, as shown in FIG. 5. Use of the jet stream guide duct 8 of such a shape as shown in FIG. 5 improves the cooling ability by increasing the flow velocity of the jet stream 7.

Figure 6:
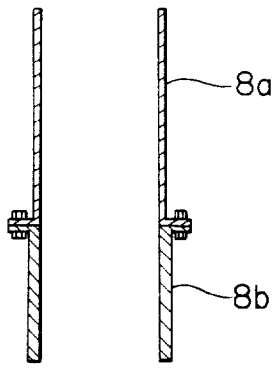
FIG. 6 is a longitudinal sectional view illustrating another embodiment of a jet stream guide duct in the cooling apparatus of the present invention.
Figure 7:
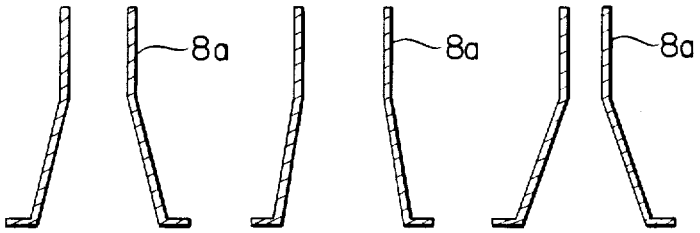
FIGS. 7(A), 7(B) and 7(C) are partially omitted longitudinal sectional views illustrating further embodiments of a jet stream guide duct in the cooling apparatus of the present invention.

If the jet stream guide duct 8 is divided, as shown in FIG. 6, into an upper jet stream guide duct 8*a* and a lower jet stream guide duct 8*b*, and the upper jet stream guide duct 8*a* is removably attached to the lower jet stream guide duct 8*b*, it is possible to easily alter the flow velocity of the jet stream 7 by preparing upper jet stream guide ducts 8*a* of various shapes as shown in FIGS. 7(A), 7(B) and 7(C).

Figure 8:
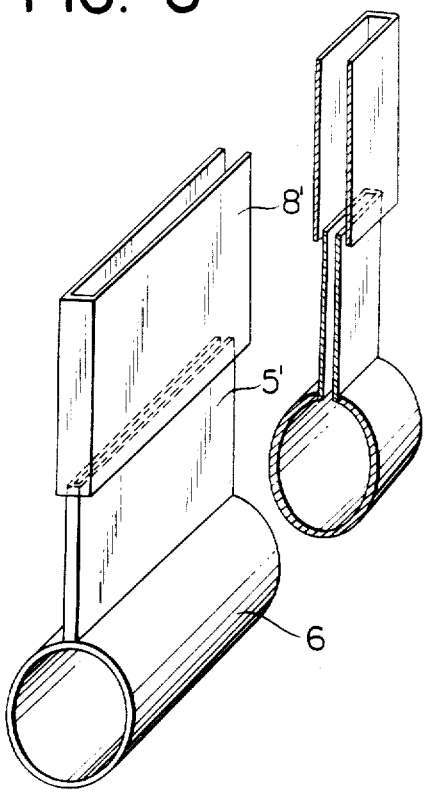
FIG. 8 is a partially omitted perspective view illustrating another embodiment of the combination of a lower cooling water ejecting nozzle fitted to a lower nozzle header and a jet stream guide duct in the cooling apparatus of the present invention.

The above-mentioned lower cooling water ejecting nozzle may be as described above, or may also be a nozzle 5' having a slit which has a length substantially equal to the width of the heated metal plate 3 and extends in parallel to the width direction of the heated metal plate 3, as shown in FIG. 8. When employing the lower cooling water ejecting nozzle 5' having the above-mentioned slit, a jet stream guide duct 8' having a slit as shown in FIG. 8 is used as the jet stream guide ducts.

The effect of cooling water from the above-mentioned lower cooling water ejecting nozzle 5 acting on the above-mentioned jet stream 7 was investigated. The results are described below.

Figure 9:
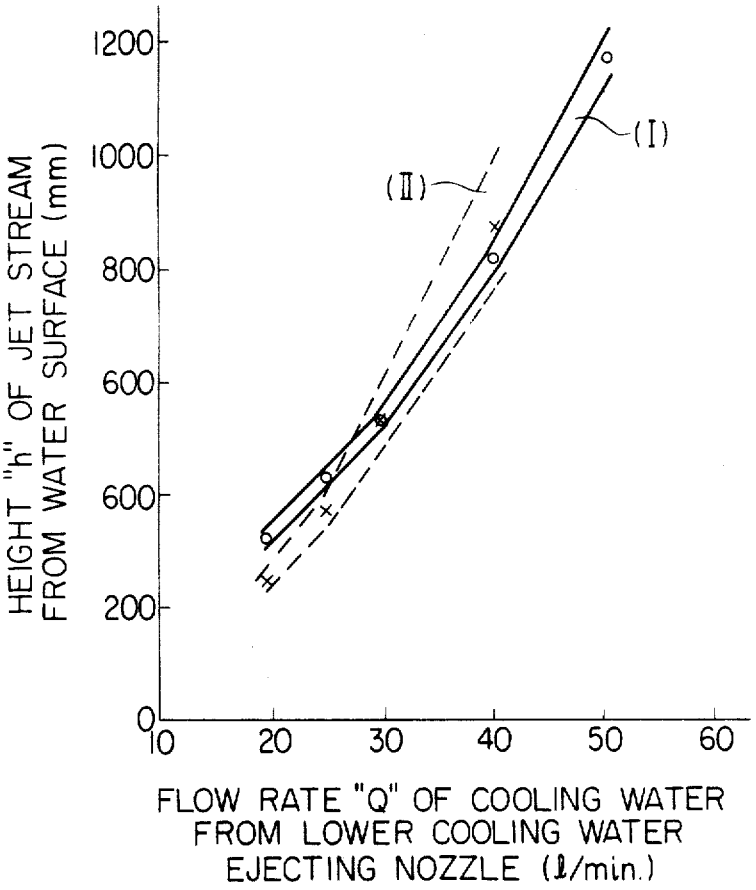
FIG. 9 is a graph illustrating the relationship between the flow rate (Q) of cooling water from the lower cooling water ejecting nozzle and the height (h) of the jet stream from the surface of cooling water in the water tank, for the apparatus of the present invention and for the conventional apparatus.

First, the relationship between the flow rate (Q) of cooling water from the lower cooling water ejecting nozzle 5 and the height (h) of the jet stream 7 from the surface of cooling water in the water tank 4 was investigated. The results are shown in FIG. 9. In FIG. 9, (I) represents the range of variations in the height (h) of the jet stream 7 in the case of using the apparatus of the present invention provided with the jet stream guide duct 8, 8', and (II) indicates the range of variations in the height (h) of the jet stream 7 in the case of using the cooling apparatus of the prior art not provided with a jet stream guide duct (hereinafter referred to as "the conventional apparatus"). The test conditions were as follows:

(1) Inside diameter (D) of the lower cooling water ejecting nozzle 5: 9 mm,
(2) Under-water distance (H) between the uppermost end of the lower cooling water ejecting nozzle 5 and the surface of cooling water in the water tank 4: 100 mm,
(3) Inside diameter (D') of the jet stream guide duct 8: 27 mm,
(4) Length ($l_1$) above the water surface of the jet stream guide duct 8: 250 mm, and
(5) Length ($l_2$) under the water surface of the jet stream guide duct 8: 100 mm.

As is clear from FIG. 9, according to the apparatus of the present invention, the range of variations in the height (h) from the water surface of the jet stream 7 is far smaller than in the conventional apparatus, in spite of the fact that dropping of the jet stream 7 after ejection onto the lower surface of the heated metal plate 3 into the water tank 4 causes considerable up and down wavy movements of the water surface. This is due to the lower portion of the jet stream guide duct 8 being immersed into cooling water received in the water tank 4.

Figure 10:
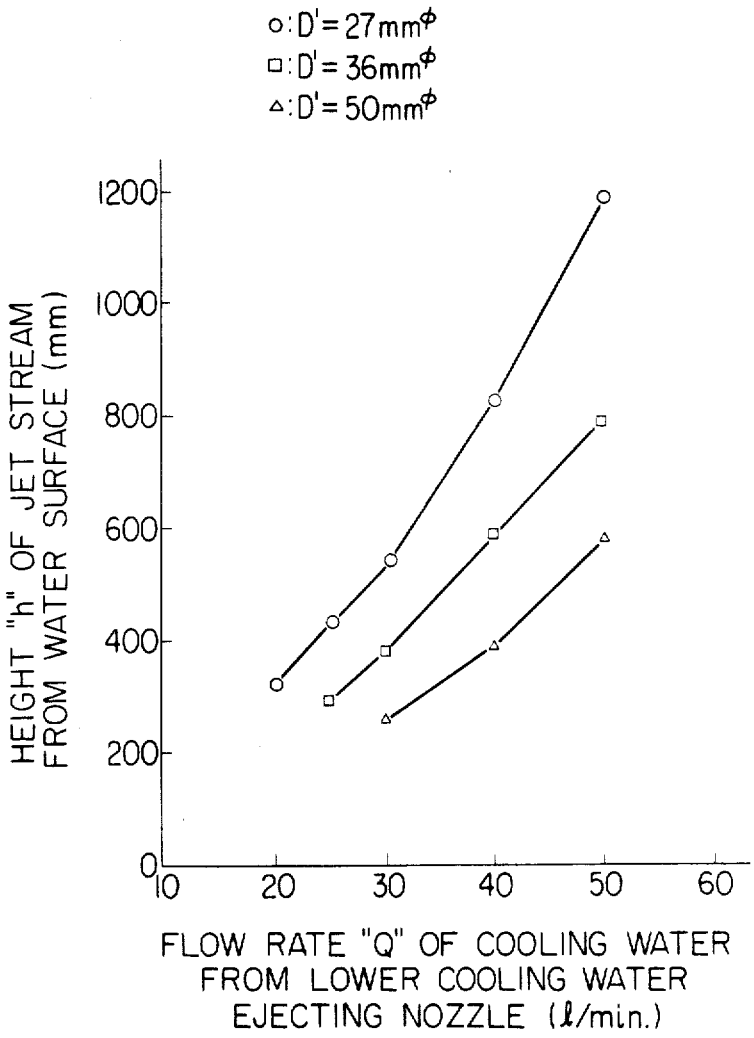
FIG. 10 is a graph illustrating the relationship between the flow rate (Q) of cooling water from the lower cooling water ejecting nozzle and the height (h) of the jet stream from the water surface of cooling water in the water tank, for the apparatus of the present invention with a jet stream guide duct having different upper and lower inside diameters.

Then, the relationship between the flow rate (Q) of cooling water from the lower cooling water ejecting nozzle 5 and the height (h) of the jet stream 7 from the surface of cooling water in the water tank 4, with various inner diameters (D') of the jet stream guide duct 8 was investigated under the same test conditions as mentioned with reference to FIG. 9. The results are shown in FIG. 10. In FIG. 10, the mark "o" represents the case with an inside diameter (D') of 27 mm of the jet stream guide duct 8; the mark "□" indicates the case with an inside diameter (D') of 36 mm of the jet stream guide duct 8; and the mark "Δ", with an inside diameter (D') of 50 mm of the jet stream guide duct 8. As is evident from FIG. 10, according to the apparatus of the present invention, a higher flow rate (Q) of cooling water from the lower cooling water ejecting nozzle 5 leads to a larger height (h) of the jet stream 7 from the water surface, and when the flow rate (Q) of cooling water from the lower cooling water ejecting nozzle 5 is kept constant, the height (h) of the jet stream 7 from the water surface becomes larger according as the jet stream guide duct 8 has a smaller inside diameter (D').

Figure 11:
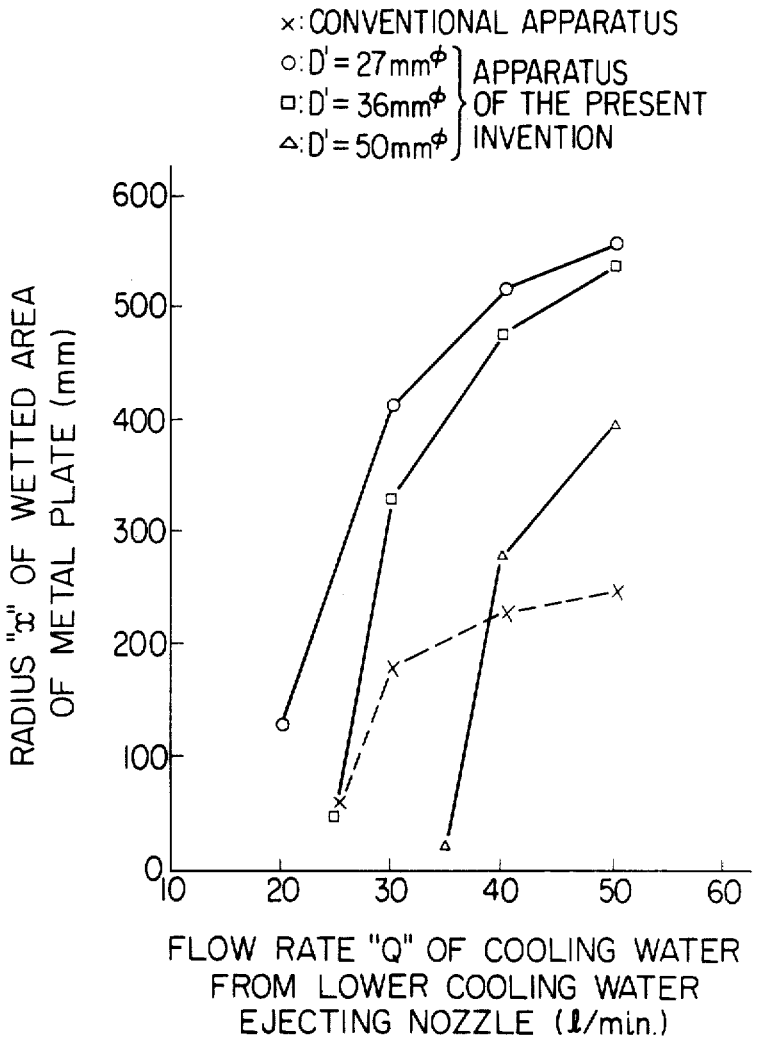
FIG. 11 is a graph illustrating the relationship between the flow rate (Q) of cooling water from the lower cooling water ejecting nozzle and the radius ($x$) of the wetted area of the heated metal plate, for the apparatus of the present invention with a jet stream guide duct having different upper and lower inside diameters and for the conventional apparatus.

Then, the relationship between the flow rate (Q) of cooling water from the lower cooling water ejecting nozzle 5 and the radius ($x$) of the wetted area of the heated metal plate 3 was investigated under the same test conditions as mentioned with reference to FIG. 9, in the case where the heated metal plate 3 was horizontally laid at a prescribed distance (B) from the surface of cooling water received in the water tank 4. The results are shown in FIG. 11. In FIG. 11, the marks "o", "□" and "Δ" represent the cases with the use of the jet stream guide ducts 8 of the present invention having respective inside diameters (D') as in FIG. 10, and the mark "x" represents the case with the conventional apparatus.

The above-mentioned radius ($x$) of the wetted area of the heated metal plate 3 means the radius of the circular flow of jet stream 7 expanding in the form of a circle along the lower surface of the heated metal plate 3 after ejection onto this lower surface. A larger radius ($x$) of the wetted area of the heated metal plate 3 leads to the possibility of cooling the heated metal plate 3 over a wider range.

As is clear from FIG. 11, the radius ($x$) of the wetted area becomes, larger according as the flow rate (Q) of cooling water from the lower cooling water ejecting nozzle 5 is increased. When the flow rate (Q) of cooling water from the lower cooling water ejecting nozzle 5 is kept constant, it is possible to increase the radius ($x$) of the wetted area to a larger extent in the apparatus of the present invention than in the conventional apparatus, and according to the apparatus of the present invention, the radius ($x$) of the wetted area can be increased by reducing the inside diameter (D') of the jet stream guide duct 8.

Figure 12:
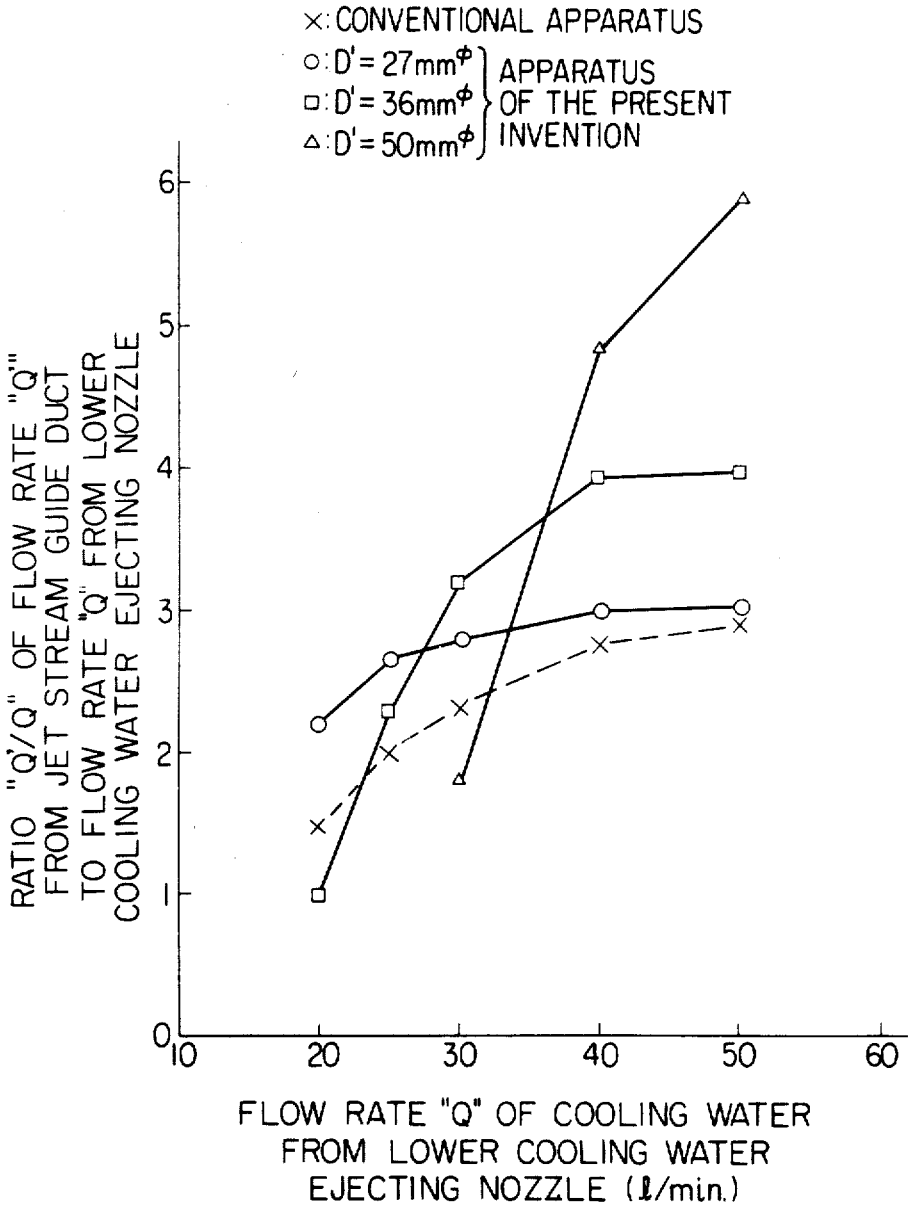
FIG. 12 is a graph illustrating the relationship between the flow rate (Q) of cooling water from the lower cooling water ejecting nozzle, on the one hand, and the ratio (Q'/Q) of the flow rate (Q') of the jet stream from the jet stream guide duct to the flow rate (Q) of cooling water from the lower cooling water ejecting nozzle, on the other hand, for the apparatus of the present invention with the jet stream guide duct having different upper and lower inside diameters and for the conventional apparatus.

Then, the relationship between the flow rate (Q) of cooling water from the lower cooling water ejecting nozzle 5, on the one hand, and the ratio (Q'/Q) of the flow rate (Q') of the jet stream 7 from the jet stream guide duct 8 to the above-mentioned flow rate (Q), on the other hand, was investigated under the same conditions as mentioned with reference to FIG. 9. The results are shown in FIG. 12. In FIG. 12, the marks "o", "□" and "Δ" represent the cases with the use of the jet stream guide ducts 8 of the present invention having respective inside diameters (D') as in FIG. 10, and the mark "x" represents the case with the conventional apparatus. As is clear from FIG. 12, the flow rate ratio (Q'/Q) becomes larger according as the flow rate (Q) of cooling water from the lower cooling water ejecting nozzle 5 is increased. When the flow rate (Q) of cooling water from the lower cooling water ejecting nozzle 5 is kept constant, it is possible to increase the flow rate ratio (Q'/Q) to a larger extent in the apparatus of the present invention than in the conventional apparatus, and according to the apparatus of the present invention, the flow rate ratio (Q'/Q) can be increased by increasing the inside diameter (D') of the jet stream guide duct 8.

Figure 13:
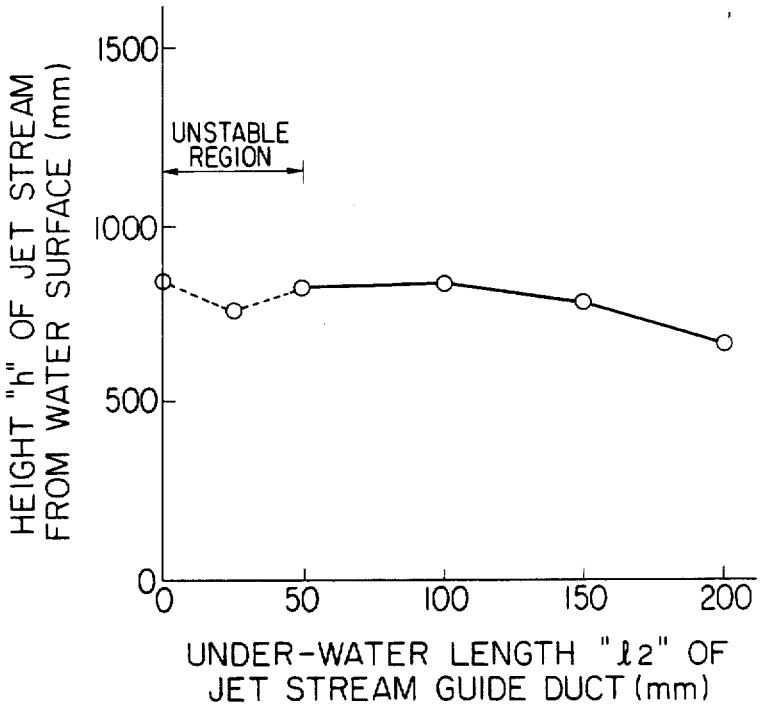
FIG. 13 is a graph illustrating the relationship between the under-water length ($l_2$) of the jet stream guide duct from the surface of cooling water in the water tank, on the one hand, and the height (h) of the jet stream from the above-mentioned water surface, on the other hand, for the apparatus of the present invention.

Then, the relationship between the under-water length ($l_2$) of the jet stream guide duct 8 from the surface of cooling water in the water tank 4, on the one hand, and the height (h) of the jet stream 7 from the above-mentioned water surface, on the other hand, was investigated. The results are shown in FIG. 13. The test conditions in this investigation were as follows:

(1) Inside diameter (D) of the lower cooling water ejecting nozzle 5: 9 mm,
(2) Under-water distance (H) between the uppermost end of the lower cooling water ejecting nozzle 5 and the surface of cooling water in the water tank 4: 100 mm,
(3) Flow rate (Q) of cooling water from the lower cooling water ejecting nozzle 5: 40 l/min.,
(4) Inside diameter (D') of the jet stream guide duct 8: 27 mm, and
(5) Length ($l_1$) of the jet stream guide duct 8 above the water surface: 250 mm.

As is clear from FIG. 13, a shorter under-water length ($l_2$) of the jet stream guide duct 8 from the surface of cooling water in the water tank 4 causes large and unstable variations in the height (h) of the jet stream 7 from the water surface. The reason is that, with a shorter under-water length ($l_2$) of the jet stream guide duct 8, dropping of the jet stream 7 results in up and down wavy movements of the water surface, and the lowermost end of the jet stream guide duct 8 may be exposed above the water surface, or bubbles produced by dropping of the jet stream 7 on the water surface may be entangled into the jet stream 7. When the above-mentioned under-water length ($l_2$) of the jet stream guide duct 8 is long, on the other hand, the height (h) of the jet stream 7 from the water surface becomes smaller. The reason is that, with a larger under-water length ($l_2$) of the jet stream guide duct 8, the uppermost end of the lower cooling water ejecting nozzle 5 penetrates too deep into the jet stream guide duct 8, making it difficult for cooling water in the water tank 4 to enter into the jet stream guide duct 8. For these reasons, the above-mentioned under-water length ($l_2$) of the jet stream guide duct 8 should be determined with due regards to the points mentioned above.

Figure 14:
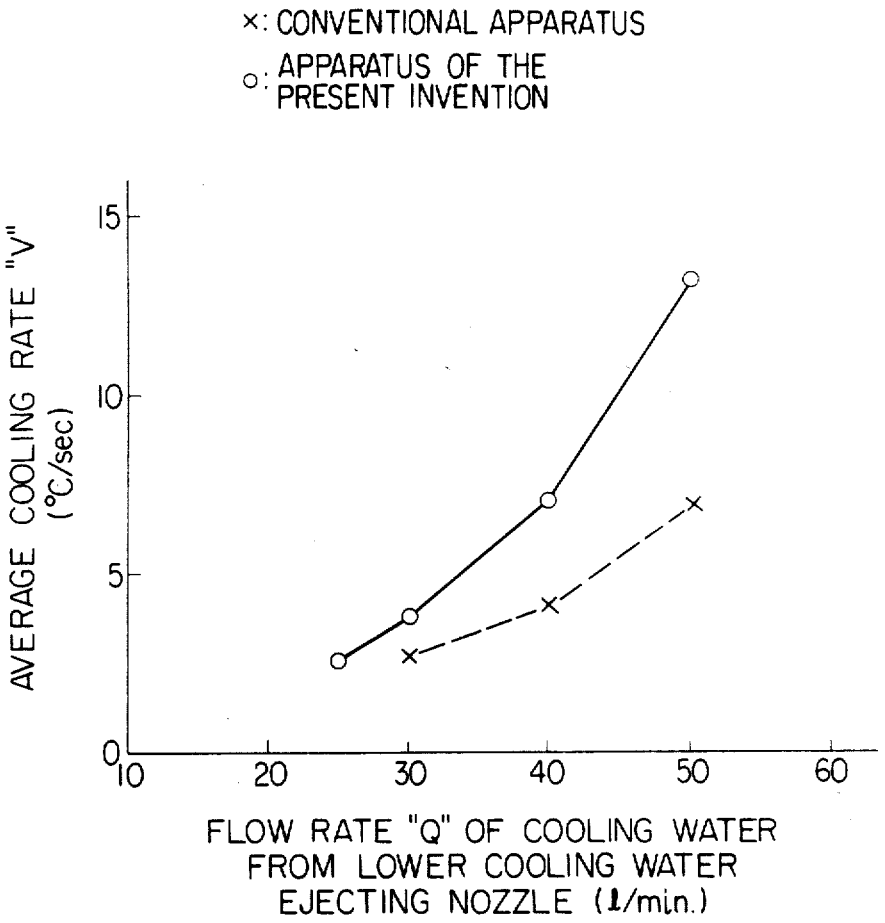
FIG. 14 is a graph illustrating the relationship between the flow rate (Q) of cooling water from the lower cooling water ejecting nozzle and the average cooling rate (V), for the apparatus of the present invention and for the conventional apparatus.

Then, the relationship between the flow rate (Q) of cooling water from the lower cooling water ejecting nozzle 5 and the average cooling rate (V), when a 32 mm thick metal plate 3 heated to the temperature of about 900° C. was cooled from 800° to 500° C. was investigated, as to the case where the heated metal plate 3 was cooled by the apparatus of the present invention and by the conventional apparatus while reciprocating the heated metal plate 3 horizontally in the longitudinal direction thereof at a speed of 30 m/minute. The results are shown in FIG. 14. In FIG. 14, the mark "o" represents the case with the apparatus of the present invention, and the mark "x" indicates the case with the conventional apparatus. The test conditions in this investigation were as follows:

(1) Inside diameter (D) of the lower cooling water ejecting nozzle 5: 9 mm,
(2) Inside diameter (D') of the jet stream guide duct 8: 27 mm,
(3) Length ($l_1$) of the jet stream guide duct 8 above the water surface: 250 mm,
(4) Under-water length ($l_2$) of the jet stream guide duct 8: 100 mm,
(5) Distance (B) between the water surface and the lower surface of the heated metal plate 3: 310 mm, and
(6) Under-water distance (H) between the uppermost end of the lower cooling water ejecting nozzle 5 and the water surface in the water tank 4: 100 mm.

As is clear from FIG. 14, when the flow rate (Q) of cooling water from the lower cooling water ejecting nozzle 5 is identical, it is possible to cool the heated metal plate 3 to a prescribed temperature more rapidly in the apparatus of the present invention than in the conventional apparatus. Furthermore, when the average cooling rate is identical, it is possible to reduce the flow rate (Q) of cooling water from the lower cooling water ejecting nozzle 5 in a larger quantity in the apparatus of the present invention than in the conventional apparatus.

According to the apparatus of the present invention, as is evident from the test results described above, it is possible, when cooling the heated metal plate 3 lying horizontally above the water tank 4 by means of the jet streams 7 produced by cooling water from the lower cooling water ejecting nozzles 5 arranged in the water tank 4 and cooling water received in the water tank 4, to uniformly cool the heated metal plate 3 even when the surface of cooling water received in the water tank 4 moves considerably up and down, and to control the cooling rate of the heated metal plate 3 easily and over a wide range by adjusting the flow rate of cooling water from the lower cooling water ejecting nozzles 5.

Figure 15:
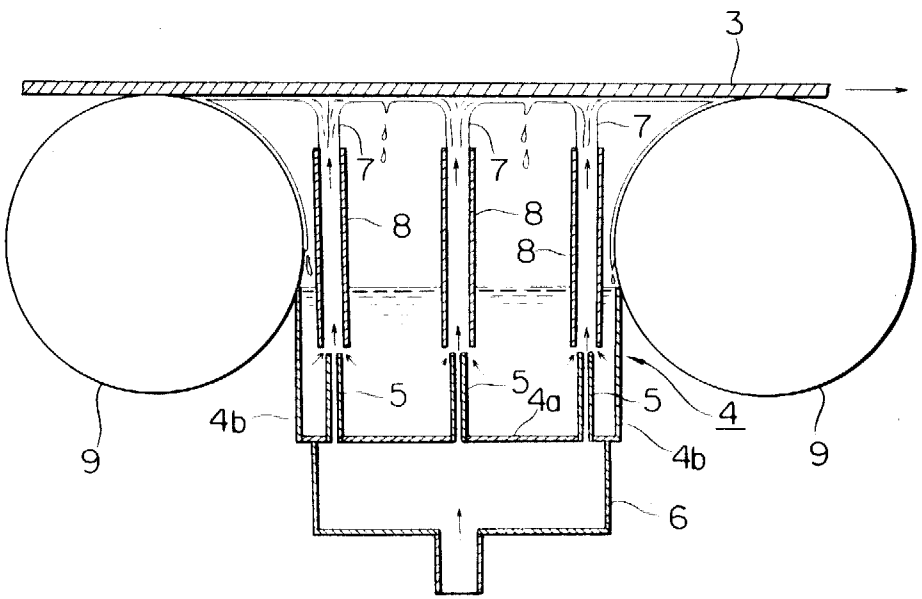
FIG. 15 is a cross-sectional view illustrating the state of cooling a heated metal plate by an embodiment of the apparatus of the present invention.

Now, an embodiment of the cooling apparatus of the present invention is described with reference to FIG. 15. FIG. 15 is a cross-sectional view illustrating the state of cooling a heated metal plate by an embodiment of the apparatus of the present invention. As shown in FIG. 15, a heated metal plate 3 travels horizontally in the longitudinal direction thereof on conveyor rollers 9. A water tank 4 comprising a bottom wall 4*a* and side walls 4*b* is arranged below the heated metal plate 3 in each of the spaces between two adjacent conveyor rollers 9. The length of the water tank 4 in the width direction of the heated metal plate 3 is slightly longer than the width of the heated metal plate 4, and the length of the water tank 4 in the travelling direction of the heated metal plate 3 is substantially equal to the distance between two adjacent conveyor rollers 9. Thus, the total amount of a jet stream described later after ejection onto the lower surface of the heated metal plate 3 is collected into the water tank 4. On the bottom wall 4*a* of the water tank 4, a plurality of lower cooling water ejecting nozzles 5 are vertically arranged spaced apart from each other at prescribed intervals along at least one straight line parallel to the width direction of the heated metal plate 3. In the embodiment of the apparatus of the present invention as shown in FIG. 15, the plurality of lower cooling water ejecting nozzles 5 are arranged on the bottom wall 4*a* of the water tank 4 along each of three straight lines parallel to the width direction of the heated metal plate 3. The uppermost end of each lower cooling water ejecting nozzle 5 is located under the surface of cooling water received in the water tank 4. A jet stream guide duct 8 is arranged substantially vertically between each lower cooling water ejecting nozzle 5 and the lower surface of the heated metal plate 3. A lower nozzle header 6 for supplying cooling water to the lower cooling water ejecting nozzles 5 is connected to the lower surface of the bottom wall 4*a* of the water tank 4. Above the heated metal plate 3, a plurality of upper cooling water ejecting nozzles (not shown) similar to those shown in FIG. 1 are arranged spaced apart from each other at prescribed intervals along at least one straight line parallel to the width direction of the metal plate 3, and eject cooling water substantially vertically onto the upper surface of the metal plate 3.

In the above-mentioned cooling apparatus of the present invention, when cooling water is supplied from the lower nozzle header 6 to the lower cooling water ejecting nozzles 5 in the state of the water tank 4 filled with cooling water, both cooling water from each lower cooling water ejecting nozzle 5 and cooling water received in the water tank 4 are ejected in the form of a jet stream 7 through the jet stream guide duct 8 substantially vertically onto the lower surface of the heated metal plate 3 during travelling. At the same time, cooling water supplied from the upper nozzle header 1 shown in FIG. 1 to the plurality of upper cooling water ejecting nozzles 2 shown also in FIG. 1 is ejected substantially vertically onto the upper surface of the heated metal plate 3. Thus, the heated metal plate 3 is uniformly cooled to a prescribed temperature. The total amount of the jet streams 7 after ejection onto the lower surface of the heated metal plate 3 is collected into the water tank 4. Cooling water in an amount substantially equal to that of cooling water supplied from the lower nozzle header 6 to the lower cooling water ejecting nozzles 5 overflows from the water tank 4.

Figure 16:
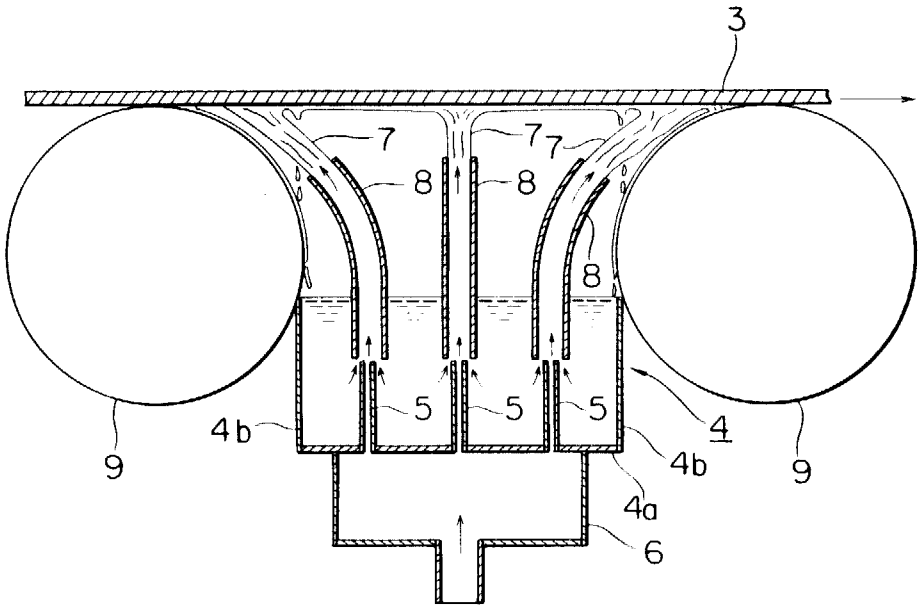
FIG. 16 is a cross-sectional view illustrating the state of cooling a heated metal plate by another embodiment of the apparatus of the present invention.

As shown in FIG. 16, it is possible to eject the jet streams 7 onto every corner of the heated metal plate 3 by bending the upper portions of the jet stream guide ducts 8 which are located near the conveyor rollers 9 toward the conveyor rollers 9.

The above-mentioned embodiments cover cases where a heated metal plate travelling horizontally above the water tank 4 is cooled by the cooling apparatus of the present invention, but it is also possible to cool a heated metal plate lying horizontally and stationarily above the water tank 4 by the cooling apparatus of the present invention.

According to the present invention, as described above, it is possible, when cooling a heated metal plate lying horizontally above a water tank to a prescribed temperature by means of jet streams produced by cooling water from lower cooling water ejecting nozzles arranged in the water tank and cooling water received in the water tank, to uniformly cool the heated metal plate even when the surface of cooling water in the water tank moves considerably up and down, prevent the cooling ability from decreasing because of the absence of bubbles entangled into the jet streams, and control the cooling rate of the heated metal plate easily and over a wide range by adjusting the flow rate of cooling water from the lower cooling water ejecting nozzles, thus providing industrially useful effects.

What is claimed is:

1. In an apparatus for continuously cooling a heated metal plate lying horizontally, which comprises:

an upper cooling water ejecting means, arranged above said metal plate along at least one straight line parallel to the width direction of said metal plate, for substantially vertically ejecting cooling water onto the upper surface of said metal plate; an upper nozzle header for supplying cooling water to said upper cooling water ejecting means; at least one water tank, arranged below said metal plate, for receiving cooling water; a lower cooling water ejecting means having a lower cooling water ejecting bore, arranged in said water tank along at least one straight line parallel to the width direction of said metal plate, said lower cooling water ejecting bore being located under the surface of cooling water received in said water tank, said lower cooling water ejecting means ejecting, in the form of a jet stream, cooling water from said lower cooling water ejecting bore together with cooling water received in said water tank, substantially vertically onto the lower surface of said metal plate, said jet stream after ejection onto the lower surface of said metal plate being totally collected into said water tank; and, a lower nozzle header for supplying cooling water to said lower cooling water ejecting means;

the improvement comprising:

a jet stream guide duct (8, 8') arranged substantially vertically between said lower cooling water ejecting means and the lower surface of said metal plate (3) so as to surround said jet stream (7), the lower portion of said jet stream guide duct being immersed into cooling water received in said water tank (4), the lowermost end of said jet stream guide duct being close to said lower cooling water ejecting bore of said lower cooling water ejecting means, and the uppermost end of said jet stream guide duct being spaced apart from the lower surface of said metal plate (3).

2. The apparatus as claimed in claim 1, wherein:

said lower cooling water ejecting bore of said lower cooling water ejecting means comprises a plurality of lower cooling water ejecting nozzles (5) arranged apart from each other in parallel to the width direction of said metal plate (3).

3. The apparatus as claimed in claim 2, wherein:

said jet stream guide duct (8) is arranged one for each of said plurality of lower cooling water ejecting nozzles (5).

4. The apparatus as claimed in claim 1, wherein:

said lower cooling water ejecting bore of said lower cooling water ejecting means comprises a lower cooling water ejecting nozzle (5') having a slit, said slit having a length substantially equal to the width of said metal plate (3) and extending in parallel to the width direction of said metal plate.

5. The apparatus as claimed in claim 1, wherein:

the upper cross-sectional area of said jet stream guide duct (8, 8') is smaller than the lower cross-sectional area thereof.

6. The apparatus as claimed in claim 4, wherein:

the upper cross-sectional area of said jet stream guide duct (8') is smaller than the lower cross-sectional area thereof.

7. The apparatus as claimed in claim 2, wherein:

the upper cross-sectional area of said jet stream guide duct (8, 8') is smaller than the lower cross-sectional area thereof.

8. The apparatus as claimed in claim 3, wherein:

the upper cross-sectional area of said jet stream guide duct (8, 8') is smaller than the lower cross-sectional area thereof.

9. The apparatus as claimed in claim 1, wherein:

the lowermost end of said jet stream guide duct is just above said lower cooling water ejecting bore of said lower cooling water ejecting means.

10. The apparatus as claimed in claim 1, wherein:

the lowermost end of said jet stream guide duct is just below the level of said lower cooling water ejecting bore of said lower cooling water ejecting means.

* * * * *